US005210881A

United States Patent [19]

Stocker, Jr. et al.

[11] Patent Number: 5,210,881

[45] Date of Patent: May 18, 1993

[54] COMBINATION GARMENT POCKET AND OBJECT

[76] Inventors: George R. Stocker, Jr., 4555 N. Malden Ave., Chicago, Ill. 60640; Howard Kenneth, 8809 Golf #11-H, Des Plaines, Ill. 60016

[21] Appl. No.: 800,274

[22] Filed: Nov. 29, 1991

[51] Int. Cl.[5] ..... A41D 27/08

[52] U.S. Cl. ..... 2/247; 2/75; 2/115; 2/244; 446/28

[58] Field of Search ..... 2/46, 48, 49 R, 50, 2/51, 69, 74, 75, 80, 94, 247, 249, 250, 115; 446/26, 28

[56] References Cited

U.S. PATENT DOCUMENTS

| | | | |
|---|---|---|---|
| 698,092 | 4/1902 | Wilkins | 2/249 |
| 1,645,502 | 10/1927 | Sweet | 2/247 |
| 2,593,218 | 4/1952 | Swain | 2/48 |
| 2,628,452 | 2/1953 | Gladstein | 446/28 |
| 2,686,313 | 8/1954 | Seidler | 446/28 X |
| 3,447,165 | 6/1969 | Brosk | 446/28 X |
| 4,138,745 | 2/1979 | Greenspan | 2/247 |
| 4,874,340 | 10/1989 | Smallwood | 446/28 |

FOREIGN PATENT DOCUMENTS

| | | | |
|---|---|---|---|
| 302520 | 12/1928 | United Kingdom | 446/26 |
| 8802605 | 4/1988 | World Int. Prop. O. | 446/28 |

*Primary Examiner*—Clifford D. Crowder
*Assistant Examiner*—Jeanette E. Chapman
*Attorney, Agent, or Firm*—Martin Faier; Eugene F. Friedman

[57] ABSTRACT

A pocket for a garment adapted to removably receive an object having appendages partially visible therein, wherein the pocket is a panel of flexible yieldable material which has a top and sides, with openings therethrough, and the object may be inserted into the pocket with its appendages extending through the top and a side opening. The pocket may have a bottom side parallel to the top side and opposed parallel sides and tapered sides between the parallel sides and bottom side, and openings through the tapered sides. The garment may have graphic indicia arranged on it and the object, when secured in the pocket, forms a part of the graphic indicia.

15 Claims, 1 Drawing Sheet

FIG. 1
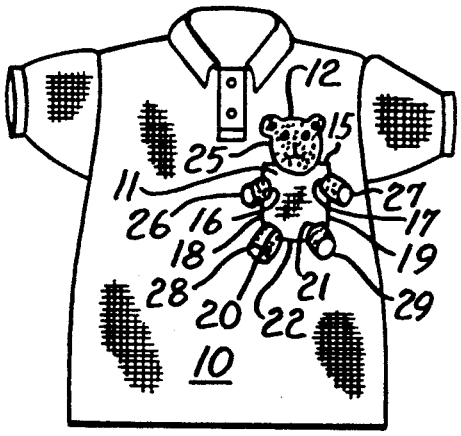
FIG. 2
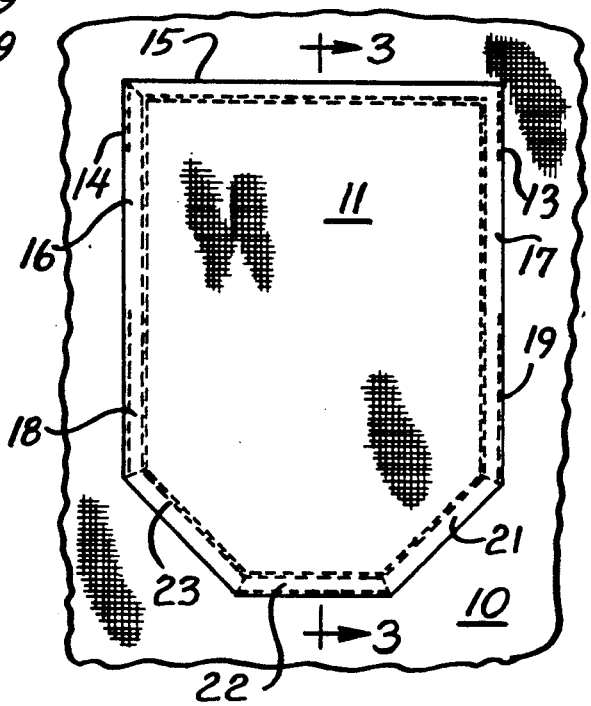
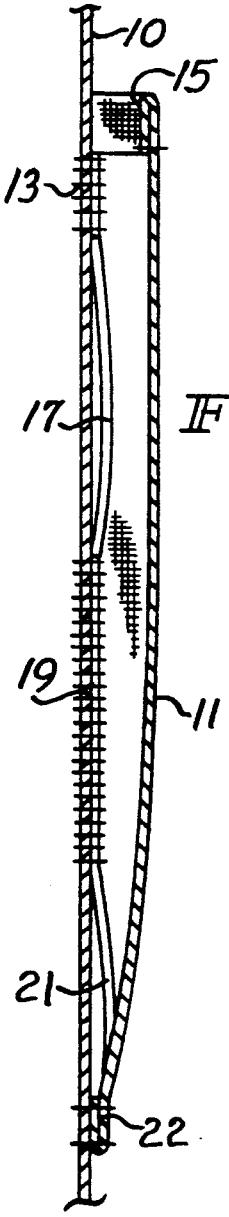
FIG. 3
FIG. 4
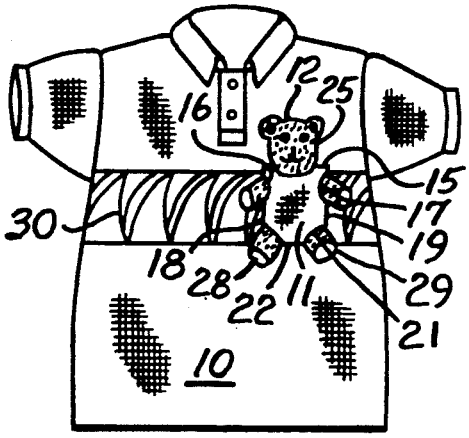

COMBINATION GARMENT POCKET AND OBJECT

BACKGROUND AND SUMMARY OF THE INVENTION

This invention relates to a combination garment pocket and object and is more particularly directed to such an assemblage for use by or with a child or other person which provides a novel display and carrying means for an object, such as a toy like a stuffed animal or a doll, or other item.

In fashion people are always seeking clever means for displaying an item on a garment. Particularly, small children are usually interested in toys, such as stuffed animals, like a teddy bear, or a doll or a special toy, like a model car, and are even more fascinated when there is an out of the ordinary or unique means for displaying and carrying such a object. The present invention consists of a novel pocket arrangement for a garment combined with such an item, which is held and displayed in a surprising way and is particularly useful to entertain a child.

A typical garment embodying the invention may consist of a Tee shirt or other garment which has secured on it a special shaped pocket. This pocket may be sewn on opposite edges, but is specially constructed to provide slits for receiving therein a toy or other object which is held in the pocket and removable therefrom, but where the slits and pocket are specially sized and arranged to hold the toy or other object but yet keep it visible and accessible and removable from the pocket. The pocket and the object must be constructed to permit the object to be carried and easily removable from and insertable into the pocket, and where the object in the pocket is visible, particularly in the case of a toy, to the child.

The object in the pocket may also form a three dimensional part of an overall design in combination with a two dimensional picture or graphic arranged on the garment and pocket. For example, the garment and pocket may have a scene printed on it and the three dimensional object may fit into the pocket and form a part of the illustration, such as a jungle scene which shows a tree branch printed on the garment and a teddy bear nested in the tree branch.

The object is preferably of an animal or humanoid form, such as a stuffed animal or doll, and must be of a size and shape to be removably secured in the pocket (and, of course, a toy car or the like can be similarly constructed for removable securement in the pocket). Preferably, the pocket and the object are of a soft fabric-like material, so that fabric-like pocket material may be slightly stretched and the soft object may be slightly compressed to accommodate the object in the pocket.

OBJECTS AND ADVANTAGES OF THE INVENTION

It is the object of the present invention to provide a combination garment pocket and object removably securable therein of the character recited.

Another object is to provide a garment pocket which is constructed to removably secure an object such as a toy partially visibly therein.

Another object is to provide a garment pocket which has opposed slits to accommodate an object such as a toy easily removably secured and partially visible therein.

Another object is to provide an object removably secured in a pocket of a garment which forms a part of a design or illustration applied to the garment.

Another object is to provide a compressible object adapted for easy insertion into and removal from a yieldable fabric-like pocket of a garment, wherein the pocket is constructed with holding means cooperating with said object for easily removably securing said object partially visible in said pocket.

It is the further object of the invention to provide such a combination garment pocket and object which is easy, efficient, entertaining, relatively inexpensive and simple to construct and use.

These and other objectives and advantages will become more apparent as this description proceeds, taken in conjunction with the accompanying drawings.

BRIEF DESCRIPTION OF THE DRAWINGS

In the drawings,

FIG. 1 is a plan view of a garment having a pocket and an object (in this case a toy) removably secured therein and embodying the present invention.

FIG. 2 is an enlarged plan view of a pocket for use in the invention.

FIG. 3 is a sectional view of the pocket shown in FIG. 2, taken on line 3—3 thereof.

FIG. 4 is a plan view similar to FIG. 1, except showing an embodiment where a graphic design on the garment incorporates and forms a part of the invention.

DESCRIPTION OF PREFERRED EMBODIMENTS

With reference to the accompanying drawings, a Tee shirt 10 or other garment has secured to it a pocket 11, which contains an object like a toy 12, such as a teddy bear or the like. Preferably, this garment 10 is constructed of yieldable fabric and the object or toy 12 is compressible, like a stuffed animal, so that the toy may be compressed and the pocket 11 may be stretched during entry of the toy into and removal of the toy from the pocket, and the pocket and toy will resume their natural condition after such manipulation. The pocket 11 should be of a size sufficient to hold therein a sufficient portion of the toy 12 to secure it in the pocket.

This pocket 11 may be constructed with an open top seam 15, opposed top closed side seams 13 and 14, opposed open side seams 16 and 17, closed opposed bottom side seams 18 and 19, open opposed bottom seams 20 and 21, and closed bottom seam 22. Preferably, all of the seams 13 - 22 are sewn at 23 through the pocket, to provide finished edges, but the closed seams 18, 19, and 22 are also sewn through the garment 10, to join the pocket 11 securely to the garment. The open seams 15, 16 and 17, and 20 and 21 should be arranged to permit the appendages of the toy 12, such the head 25, arms 26 and 27 and legs 28 and 29 to fit through the slits in the pocket formed by the open seams 15, 16 and 17 and 20 and 21, respectively, thus allowing a part of the toy 12 to be visible in the pocket 11 while holding it securely, but removable, therein.

As shown in the FIG. 4 embodiment, the garment 10 may be given a three dimensional appearance by applying a two dimensional design 30 in the vicinity of the pocket 11, and this design may have worked into it the display of the three dimensional toy 12 secured in the pocket 11. For example, the two dimensional design 30 may consist of a tree branch printed on the garment 10 (not shown) where the toy 12 is positioned in the pocket 11 to make it appear that the toy, which may be a koala bear, is nested on the tree branch; or the design 30 may be of a fanciful highway and the toy 12 may appear like a toy automobile which can be removed from or placed upon the highway design; or the design may be a bed and the toy 12 may be a doll which can be put in position on the bed. In any event, this design 30 may be of any configuration, flat or dimensional, the important consideration being that the three dimensional toy 12 forms a part of the design 30 by its positioning in the pocket 12, and when removed changes the visual impression of the garment 10.

It has been found that an arrangement of the kind described in this application holds the interest of and fascinates small children. The child is surprised by the appearance of the toy in the pocket on the garment and usually wants to be a part of the unusual circumstance of wearing the toy. There is also a "hide and seek" aspect to the arrangement of such a garment pocket and toy, which captivates the child. Not only is the child entertained, but the manipulation of the toy into and from the pocket helps the child learn manual dexterity and the association of the toy and garment pocket shows the child an intended relationship between them, making such a combination pleasant and entertaining, and useful and educational for small children.

It is also believed that the arrangement of a special pocket on a garment and an object removably nested within the pocket, as to be at least partially visible an easily removable and reinsertable, may also provide means for making a fashion statements and providing decoration on garments and for objects other than toys, an important factor being that the object have extending therefrom appendages on its sides or bottom and the pocket is constructed with openings for accommodating those appendages.

While preferred embodiments of the invention have been shown and described in considerable detail, it is not intended that the invention should be limited to the exact construction disclosed, as many variations in the structure may be made without department from the spirit or scope of the invention.

Accordingly, we claim:

1. A combination garment pocket and object comprising a pocket secured on a garment, said pocket having openings therein, and an object removably secured in said pocket with portions of said object extending outside of said pocket through a plurality of said openings, said portions of said object being visible when said object is positioned in said pocket, said pocket having a top and side seams, said openings being positioned along said side and top seams and arranged on opposed sides of said pocket, at least one opening in said pocket through which one of said portions extends being arranged on a side of said pocket angularly disposed to another opening therein through which another portion of said object extends.

2. In the combination garment pocket and object recited in claim 1, wherein said pocket is fabricated from yieldable fabric.

3. In the combination garment pocket and object recited in claim 1, wherein said object is fabricated from compressible material.

4. In the combination garment pocket and objected recited in claim 1, wherein said object comprises a soft toy.

5. In the combination garment pocket and objected recited in claim 1, wherein said pocket has seams sewing its periphery to said garment except at said openings.

6. In the combination garment pocket and objected recited in claim 5, wherein said openings are defined by slits at the sides of said pocket interspersed with said seams.

7. In the combination garment pocket and objected recited in claim 1, wherein said object has appendages extending therefrom and said appendages are adapted to enter the openings and are removably secured in said openings.

8. In the combination garment pocket and objected recited in claim 1, wherein said garment has graphic indicia decorating it adjacent to said pocket and said object when secured in said pocket forms a part of said graphic indicia.

9. In the combination garment pocket and objected recited in claim 8, wherein said graphic indicia is two dimensional.

10. In the combination garment pocket and objected recited in claim 8, wherein said graphic indicia decorates said pocket.

11. A pocket for a garment for removably receiving an object having appendages partially visible therefrom when received in said pocket, said pocket comprising a panel of flexibly yieldable material, said panel having a top and side, and openings through said pocket to removably secured said object therein, said appendages passing through said openings when said object is received in said pocket, and seams through said panel securing the pocket to said garment except at said openings, said panels having a bottom side and tapered sides extending from said panel sides to said bottom side, said tapered sides being free of securement to said garment to define tapered openings in said pocket, at least some of said appendages when said object is received in said pocket, passing through said tapered openings.

12. In the pocket for a garment recited in claim 11, wherein said panel periphery has finished edges and said seams are arranged through said finished edges.

13. In the pocket for a garment recited in claim 11, wherein said pocket is decorated with graphic indicia and said object when inserted in said pocket forms a three dimensional part of said graphic indicia.

14. A pocket for a garment for removably receiving an object having appendages partially visible therefrom when received in said pocket, said pocket comprising a panel of yieldable materials, said panel having a top, bottom and sides, and openings through said pocket to removably secure said object therein, said appendages extending through said openings when said object is received in said pocket, and seams through said panel securing said pocket to said garment except at said openings, at least two openings in said panel at said seams angularly disposed to one another being free of securement to said garment, and said appendages removably extending through said two openings when said object is received in said pocket.

15. In the pocket recited in claim 14, wherein said garment is decorated with flat two dimensional graphic indicia adjacent said pocket, and said object when secured in said pocket forms a three dimensional part of said graphic indicia.

* * * * *